US005535447A

United States Patent [19]

Stevens et al.

[11] Patent Number: 5,535,447

[45] Date of Patent: Jul. 16, 1996

[54] MESH GARMENT WITH DRAPE AIDING ATTACHMENT

[76] Inventors: Larry W. Stevens, 4000 W. Swallow St., Orange, Tex. 77630; Karen S. Lapeyrolerie, 184 Lafitte St., Bridge City, Tex. 77611

[21] Appl. No.: 410,412

[22] Filed: Mar. 27, 1995

Related U.S. Application Data

[63] Continuation of Ser. No. 129,475, Sep. 30, 1993, abandoned.

[51] Int. Cl.[6] ..... A41D 13/00

[52] U.S. Cl. ..... 2/4; 2/2; 2/84; 2/94; 2/202

[58] Field of Search ..... 2/2, 4, 84, 85, 2/93, 94, 202, 205, 2.5, 69

[56] References Cited

U.S. PATENT DOCUMENTS

| | | | |
|---|---|---|---|
| 3,582,989 | 6/1971 | Fassbender | 2/4 |
| 4,716,594 | 1/1988 | Shannon | 2/4 |
| 5,091,993 | 3/1992 | Merrill et al. | 2/4 |
| 5,119,510 | 6/1992 | Schilling | 2/4 |
| 5,249,307 | 10/1993 | Lemoine | 2/4 |

FOREIGN PATENT DOCUMENTS

| | | | |
|---|---|---|---|
| 490347A1 | 6/1992 | European Pat. Off. | 2/2 |
| 1190657 | 10/1959 | France | 2/94 |

*Primary Examiner*—Diana Biefeld

[57] ABSTRACT

A new and improved protective mesh garment apparatus for protecting a wearer's head and body includes a flaccid, cylindrical head covering assembly, made from mesh material, for completely covering the head and neck of the wearer, and for covering a portion of the chest, shoulders, and back of the wearer. The apparatus also includes a flaccid, cylindrical body covering assembly, made from mesh material, for completely covering the body of except for a portion of the wearer's legs above the wearer's ankles. The body covering assembly includes a central cylindrical portion and two arm portions. The central cylindrical portion includes a top open end and a bottom open end. The bottom open end has a diameter sufficiently large such that the bottom open end is capable of being lowered over a wearer's head and body. The top open end has a diameter sufficiently large such that the top open end is capable of being lowered over a wearer's head but sufficiently small such that the top open end is not capable of being moved past the wearer's shoulders. The arm portions have a length and a diameter sufficient to cover the wearer's arms. A portion of the head covering assembly overlaps a portion of the body covering assembly when both the head covering assembly and the body covering assembly are worn by a wearer.

5 Claims, 4 Drawing Sheets

MESH GARMENT WITH DRAPE AIDING ATTACHMENT

This application is a continuation of application 08/129,475, filed Sep. 30, 1993, now abandoned.

BACKGROUND OF THE INVENTION

1. Field of the Invention

The present invention relates generally to protective garments worn over normal clothes, and more particularly, to a protective garment especially adapted to provide the wearer protection against insects, especially flying insects such as mosquitoes.

2. Description of the Prior Art

Garments that are especially designed to be worn while a person is hunting are well known in the art and are very often designed in a camouflage pattern. Examples of such camouflage garments are disclosed in the following U.S. Pat. Nos. 4,656,065 and 5,010,589. Another prior art camouflage device is disclosed in U.S. Pat. No. 4,792,471 for a camouflage body wrap for hunters. Such camouflaged garments and body wraps have a disadvantage. They do not protect the neck, head, and hands from insect bites, especially from flying insects such as mosquitoes. In this respect, it would be desirable if camouflaged garments were provided that protect the wearer's neck, head, and hands from bites from flying insects.

Although there are many advantages to spending time outdoors, one disadvantage is the exposure to insect bites, especially bites from flying insects. There are certain places where flying insects are especially bothersome. Such places include the Gulf Coast of the United States, especially near the swamps of Louisiana and Texas where swarms of mosquitoes, gnats, and deer flies are found. Several different approaches have been tried to reduce or eliminate the nuisance of flying insects when a person is in the outdoors and especially hunting.

One way to repel flying insects from biting a person is for the person to wear an insect repellent. Such an insect repellent, for example, is disclosed in U.S. Pat. No. 4,756,905. Use of insect repellents runs the risk of toxicity from the chemicals that are employed. It would be desirable, therefore, if insects could be repelled from biting a person without the person wearing chemical repellent agents.

Another disadvantage of using chemical insect repellents is that they have been observed to also repel the game that is being hunted. For example, it has been observed that some deer are repelled by chemical insect repellents. In this respect, it would be desirable if a way were devised to protect a person from flying insect bites without employing chemicals which may repel wild game.

Another conventional approach to protecting oneself from insect bites is to wear conventional clothing that covers extensive portions of the body. For example, long sleeved shirts, a jacket, gloves, and two pairs of pants have been employed. However, this technique is not practical in warm climates. For example, deer season may occur in certain localities, such as Texas, during relatively warm months, such as December. Therefore, if a hunter sought substantial protection against flying insects by extensive body coverage with conventional clothing, the hunter would swelter. In this respect, it would be desirable if a technique were devised which would give hunters adequate protection against flying insects without causing the wearer to experience excessive heat.

Another prior art garment that offers protection against flying insects is disclosed in U.S. Pat. No. 4,979,236 for a mesh-like garment that has two major parts: a top part for coverage of from the head to the hips; and a bottom part for coverage of from the waist to the feet, using individual leg-encompassing members. The top part is placed over the head of the person when it is worn. The bottom part is stepped into by the person when it is worn. One disadvantage of the garment disclosed in U.S. Pat. No. 4,979,236 relates to the fact that the bottom part is stepped into when it is worn. Shoes and boots often have sharp corners or protrusions which may tend to snag and tear mesh-like material that forms the legs of the garment. Stepping into such garment legs runs the risk of tearing and snagging the garment legs. In this respect, it would be desirable if a garment offered protection against flying insects that avoided risks of tearing and snagging due to shoes or boots.

A problem associated with the use of mesh-like fabrics for protective garments is that the fabrics tend to cling to the person's normal clothes. In this respect, it would be desirable if a protective garment employing mesh-like fabric would be provided which had a reduced tendency to cling to one's normal clothes under the protective garment.

Thus, while the foregoing body of prior art indicates it to be well known to use mesh-like fabrics to protect against flying insects, the prior art described above does not teach or suggest that it is desirable for a protective garment to provide a number of advantages simultaneously which include: avoiding risks of tearing and snagging due to shoes or boots; and employing mesh-like fabric in such a way that it has a reduced tendency to cling to one's normal clothes under the protective garment. The foregoing disadvantages are overcome by the unique protective mesh garment apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved protective mesh garment apparatus for protecting a wearer's head and body. The apparatus includes a flaccid, cylindrical head covering assembly, made from mesh material, for completely covering the head and neck of the wearer, and for covering a portion of the chest, shoulders, and back of the wearer. The apparatus also includes a flaccid, cylindrical body covering assembly, made from mesh material, for completely covering the body of except for a portion of the wearer's legs above the wearer's ankles. The body covering assembly includes a central cylindrical portion and two arm portions. The central cylindrical portion includes a top open end and a bottom open end. The bottom open end has a diameter sufficiently large such that the bottom open end is capable of being lowered over a wearer's head and body. The top open end has a diameter sufficiently large such that the top open end is capable of being lowered over a wearer's head but sufficiently small such that the top open end is not capable of being moved past the wearer's shoulders. The arm portions have a length and a diameter sufficient to cover the wearer's arms. A portion of the head covering assembly overlaps a portion of the body covering assembly when both the head covering assembly and the body covering assembly are worn by a wearer.

The diameter of the open end of the head covering assembly is such that the head covering assembly is capable of being placed over a hat worn on a wearer's head and completely encircling the hat, head, and neck of the wearer, and is capable of covering a portion of the chest, shoulders, and back of the wearer. When the hat has a brim, the brim permits a portion of the head covering assembly to drape over the head of the wearer without contacting the facial skin of the wearer and for improving the wearer's visibility.

In addition, a draping aid assembly may be installed in a portion of the body covering assembly. The draping aid assembly serves to lift the body covering assembly above the wearer's shoulders and/or back and serves to aid draping of the body covering assembly over the wearer's chest, shoulders, and back. By means of the draping aid according to the present invention, increased draping effect is obtained so that the protective mesh garment apparatus of the invention hangs freely at a spaced distance from the normal clothing of the wearer.

The draping aid assembly includes a pocket defined in the body covering assembly, and a pocket-insertable member for insertion into the pocket. Pockets may be sewn into the insides of the back portions of the body covering assembly proximal to the shoulders. The pocket-insertable member may include a rigid pad or block of styrofoam material.

Preferably, the mesh material is comprised of mosquito netting having a camouflage pattern.

The arm portions of the body covering assembly may have a length and a diameter sufficient to cover the wearer's arms and hands.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved protective mesh garment apparatus which has all of the advantages of the prior art and none of the disadvantages.

It is another object of the present invention to provide a new and improved protective mesh garment apparatus which may be easily and efficiently manufactured and marketed.

It is a further object of the present invention to provide a new and improved protective mesh garment apparatus which is of durable and reliable construction.

An even further object of the present invention is to provide a new and improved protective mesh garment apparatus which is susceptible of a low cost of manufacture with regard to both materials and labor, and which accordingly is then susceptible of low prices of sale to the consuming public, thereby making such protective mesh garment apparatus available to the buying public.

Still yet a further object of the present invention is to provide a new and improved protective mesh garment apparatus that protects the wearer's neck, head, and hands from bites from flying insects.

Still another object of the present invention is to provide a new and improved protective mesh garment apparatus that protects a person from being bitten by flying insects without the person wearing chemical repellent agents.

Yet another object of the present invention is to provide a new and improved protective mesh garment apparatus that protects a person from flying insect bites without employing chemicals which may repel wild game.

Even another object of the present invention is to provide a new and improved protective mesh garment apparatus that gives hunters adequate protection against flying insects without causing the wearer to experience excessive heat.

Still a further object of the present invention is to provide a new and improved protective mesh garment apparatus that provides protection against flying insects while avoiding risks of tearing and snagging the garment due to shoes or boots.

Yet another object of the present invention is to provide a new and improved protective mesh garment apparatus that employs mesh-like fabric and that has a reduced tendency to cling to one's normal clothes under the protective garment.

Even another object of the present invention is to provide a new and improved protective mesh garment apparatus that has good camouflage characteristics.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved protective mesh garment apparatus embodying the principles and concepts of the present invention will be described.

Figure 1:
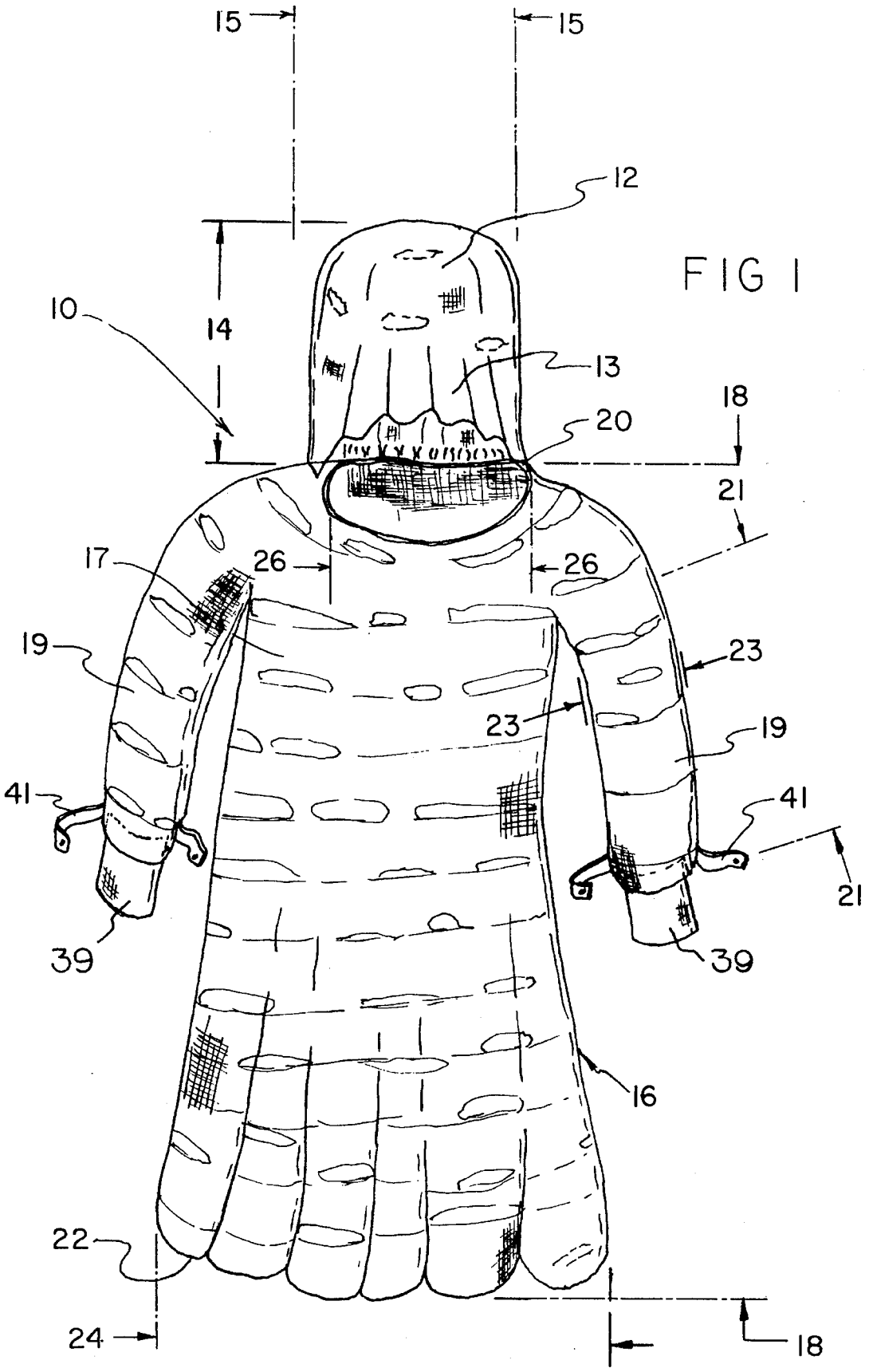
FIG. 1 is an elevational view in perspective of a first preferred embodiment of the protective mesh garment apparatus of the invention as seen from the front thereof.
Figure 2:
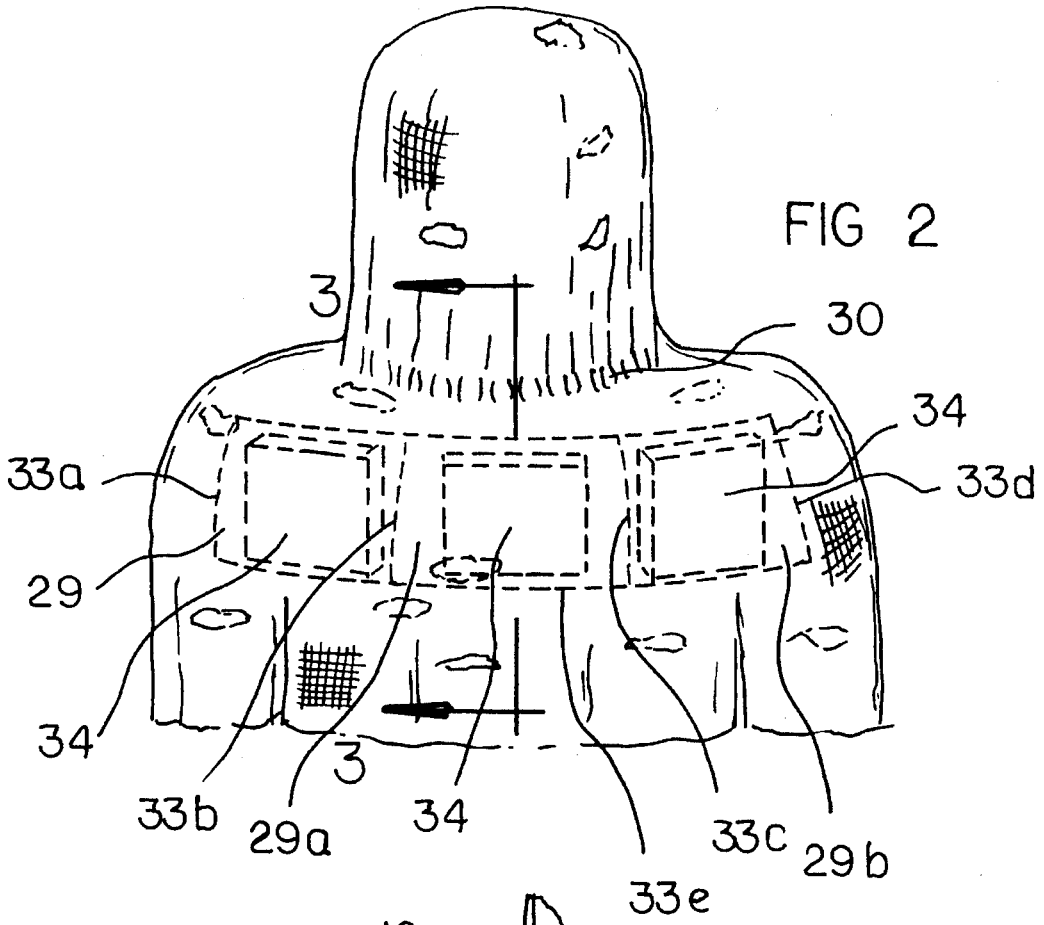
FIG. 2 is a partial view of the upper portion of the embodiment of FIG. 1 as from the rear thereof.

Turning initially to FIG. 1, there is shown a first exemplary embodiment of the protective mesh garment apparatus of the invention generally designated by reference numeral 10. In its preferred form, protective mesh garment apparatus 10 is used to protect a wearer's head, neck, chest, shoulders, back, abdomen, backside, arms, and a portion of the wearer's legs from biting from insects. The apparatus 10 includes a flaccid, cylindrical head covering assembly 12, made from mesh material, for completely covering the head and neck of the wearer, and for covering a portion of the chest, shoulders, and back of the wearer (see FIG. 4). The head covering assembly 12 has a length 14 and includes an open end 13 having a diameter 15, such that the head covering assembly 12 is capable of being placed over a wearer's head and is capable of completely covering the head and neck of the wearer and of covering a portion of the chest, shoulders, and back of the wearer. Preferably, the head covering assembly is connected to the body covering assembly by a gathered seam 30 along the back of the neck opening 20 as best seen in FIG. 2 such connection being accomplished in the desired manner by suitably sewing the head covering assembly to the body covering assembly. By this construction the head covering assembly may be caused to conveniently drape on the back of the body covering assembly when not in position over the wearer's head. Because of the open weave character of the mesh material, good visibility is relatively unimpaired despite the lack of eye openings or any other openings in the head covering assembly.

A flaccid, cylindrical body covering assembly 16, made from mesh material, is used for completely covering the shoulders, chest, back, abdomen, backside, arms, and a portion of the wearer's legs above the wearer's ankles. The body covering assembly 16 includes a central cylindrical portion 17 and two arm portions 19. The central cylindrical portion 17 has a length 18 and includes a top the aforementioned open end 20 and a bottom open end 22. The bottom open end 22 has a diameter 24 sufficiently large such that the bottom open end 22 is capable of being lowered over a wearer's head, shoulders, chest, back, abdomen, backside, arms, hands, and a portion of the wearer's legs above the wearer's ankles. The top open end 20 has a diameter 26 sufficiently large such that the top open end 20 is capable of being lowered over a wearer's head but sufficiently small such that the top open end 20 is not capable of being moved past the wearer's shoulders. Because the central cylindrical portion 17 is lowered onto the head and body of the wearer from above, tearing and snagging due to shoes or boots is avoided. As shown in FIG. 1, the length 18 of the central cylindrical portion 17 is sufficient for the central cylindrical portion 17 to cover the wearer's legs to a point above the ankles and below the mid-calves.

The arm portions 19 have a length 21 and a diameter 23 sufficient to cover the wearer's arms. In FIG. 1, the length 21 of the arm portions 19 is not sufficient to cover the wearer's hands. Instead, the arm portions 19 extend to the wearer's wrists and have tubular or cylindrical extensions 39 which extend to cover the wearer's hands generally up to and over the knuckles of the wearer's fingers, but leaving the finger tips free to manipulate a firearm, bow and/or bowstring, and the like. Wrist straps 41 can be used to tighten the arm portions 19 around the wrists of the wearer to prevent insects from flying up the arm portions 19. The wrist straps 41 can be fastened together with hook and loop fastener material such as VELCRO (TM). Other suitable fasteners can also be used.

Figure 5:
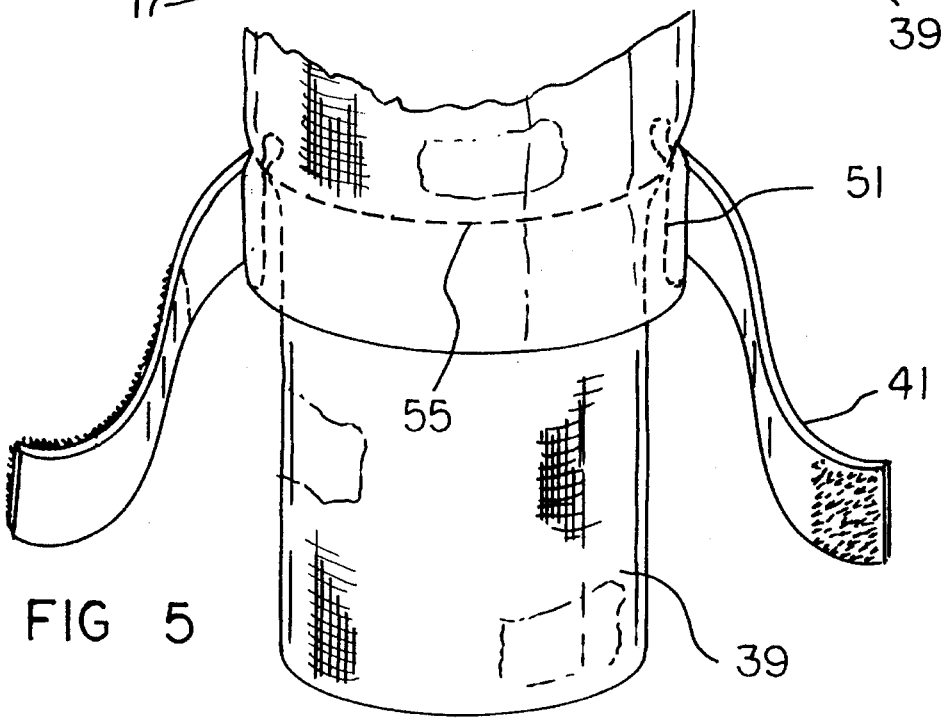
FIG. 5 is an enlarged partial view in perspective showing the cuff construction of the present invention.

As shown in greatest detail in FIG. 5, the tubular extensions 39 have a top portion 51 folded down over the top thereof to form a hem and which preferably is attached to the inside of each sleeve 19 near the distal extremity thereof as by sewing the parts together along a circumferential seam 55. In use, the hands of the wearer may be completely withdrawn into the sleeve and the tubular extensions drawn up into the sleeve after the sleeve ends have been fastened about the wrist to completely protect the hands from insect bite.

Figure 4:
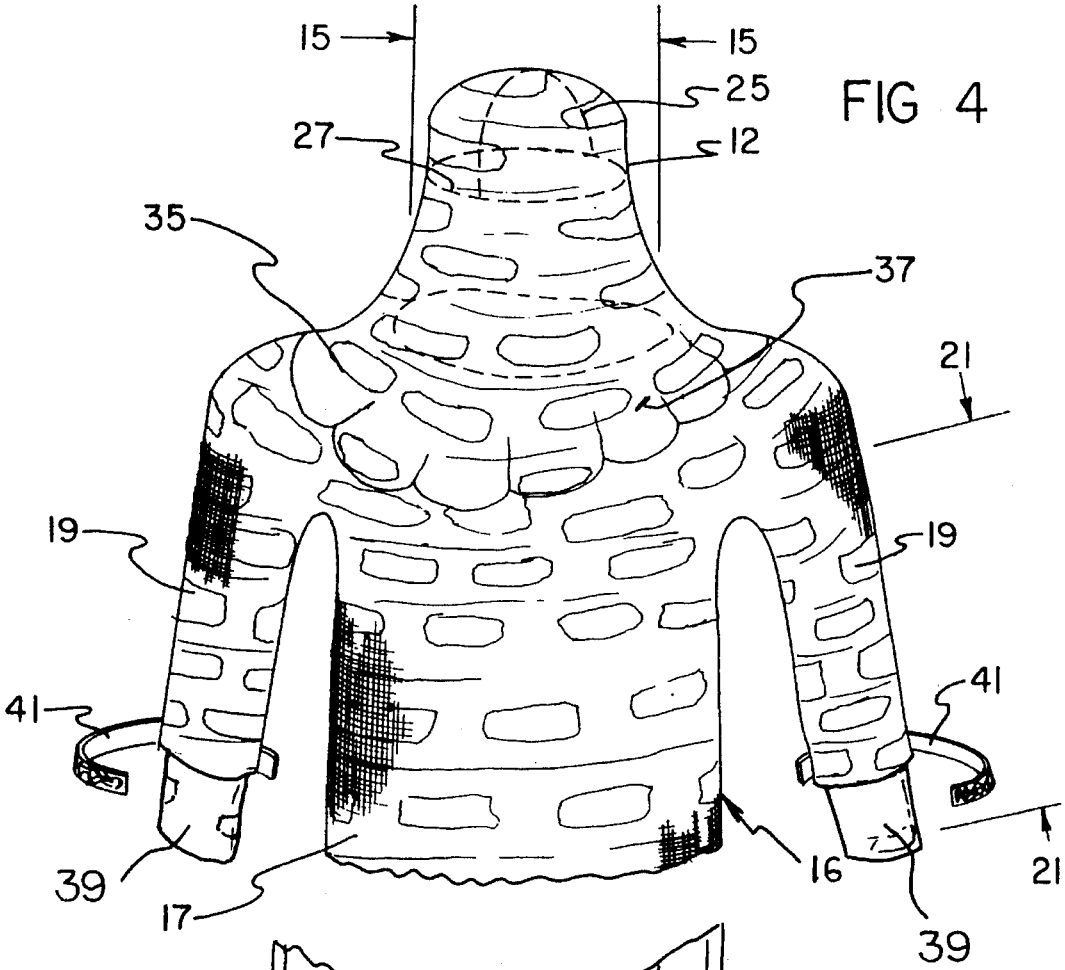
FIG. 4 is a partial view of a second preferred embodiment of the invention as seen from the front.

As shown in FIG. 4, a portion 35 of the head covering assembly 12 overlaps a portion 37 of the body covering assembly 16 when both the head covering assembly 12 and the body covering assembly 16 are worn by a wearer. Also in FIG. 4, the diameter 15 of the open end 13 of the head covering assembly 12 is such that the head covering assembly 12 is capable of being placed over a hat 25 worn on a wearer's head. The head covering assembly 12 is capable of completely encircling the hat, head, and neck of the wearer and is capable of covering a portion of the chest, shoulders, and back of the wearer. The hat 25 has a brim 27, and the brim 27 permits a portion of the head covering assembly 12 to drape over the head of the wearer without contacting skin of the wearer and with improving the wearer's visibility.

Figure 3:
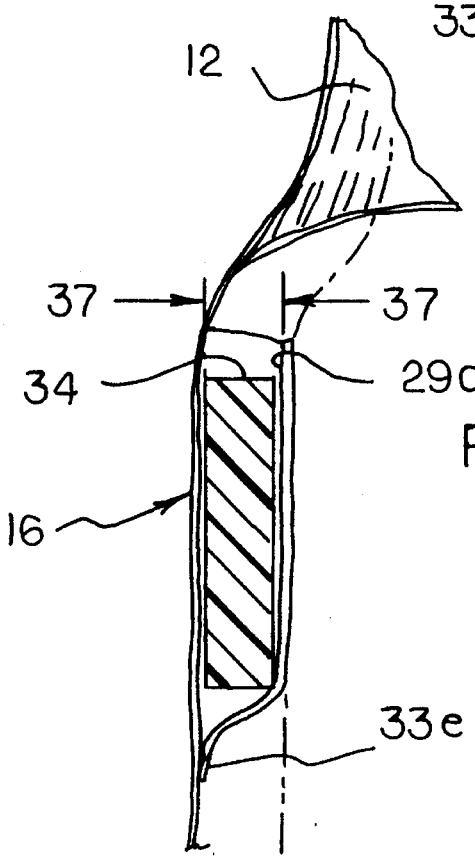
FIG. 3 is a cross-sectional view taken along line 3—3 of FIG. 2.

Aside from the features of the protective mesh garment apparatus of the invention discussed above with respect to FIG. 4, a second embodiment of the invention is shown in FIGS. 2 and 3. More specifically, a draping aid assembly is installed in the shoulder portions and the upper back portions of the body covering assembly 16.

As shown in FIGS. 2 and 3, in accordance with the present invention a draping aid assembly may be installed in a back portion of the body covering assembly extending transversely across the shoulders under and proximal to the head covering assembly attachment seam 30. The draping aid assembly is used for lifting the body covering assembly 16 away from the wagerer's normal clothing and for aiding draping of the body covering assembly 16 over the wearer's shoulders and back. More specifically, the draping aid assembly includes a series of pockets formed in the body covering assembly 16 by a rectangular insert preferably sewn to the inside surface of the body covering assembly. The insert preferably is divided into three sections or pockets 29, **29*a*, and 29*b* by vertically extending sewn seams 33*a*, 33*b*, 33*c*, and 33*d*. A horizontally extending sewn seam 33*e* attaches the bottom of the insert to the inside surface of the body covering assembly. A pocket-insertable member 34, preferably comprising a rigid block or pad of styrofoam material, is adapted to be placed into each of the three pockets 29, 29***a* and 29*b* as schematically indicated by the broken-lines in FIG. 2. The insertable members 34 when placed in pockets 29, 29*a* and 29*b* respectively, thus maintain the body covering assembly in a draped manner spaced away from the shoulders and back of the wearer thereby enhancing ventilation and comfort. In this regard, insertable members 34 each may have a width or thickness dimension 37 in the range from about 1.5 inches to about 5.0 inches depending upon individual preference.

Also as shown in FIGS. 1 and 4, the arm portions may have a length 21 and a diameter 23 sufficient to cover the wearer's arms and hands. It is noted that the length 21 in FIG. 4 is longer than the length 21 in FIG. 1, where the arm portions 19 are not long enough to cover the hands. In FIG. 4, the arm portions 19 include finger-covering extensions or portions 39, which provide protection for the hands and fingers of the wearer. Wrist straps 41 can be used to tighten the arm portions 19 around the wrists of the wearer in a manner believed apparent. The wrist straps 41 preferably are fastened together with hook and loop fastener material such as that sold under the VELCRO Trademark.

Figure 6:
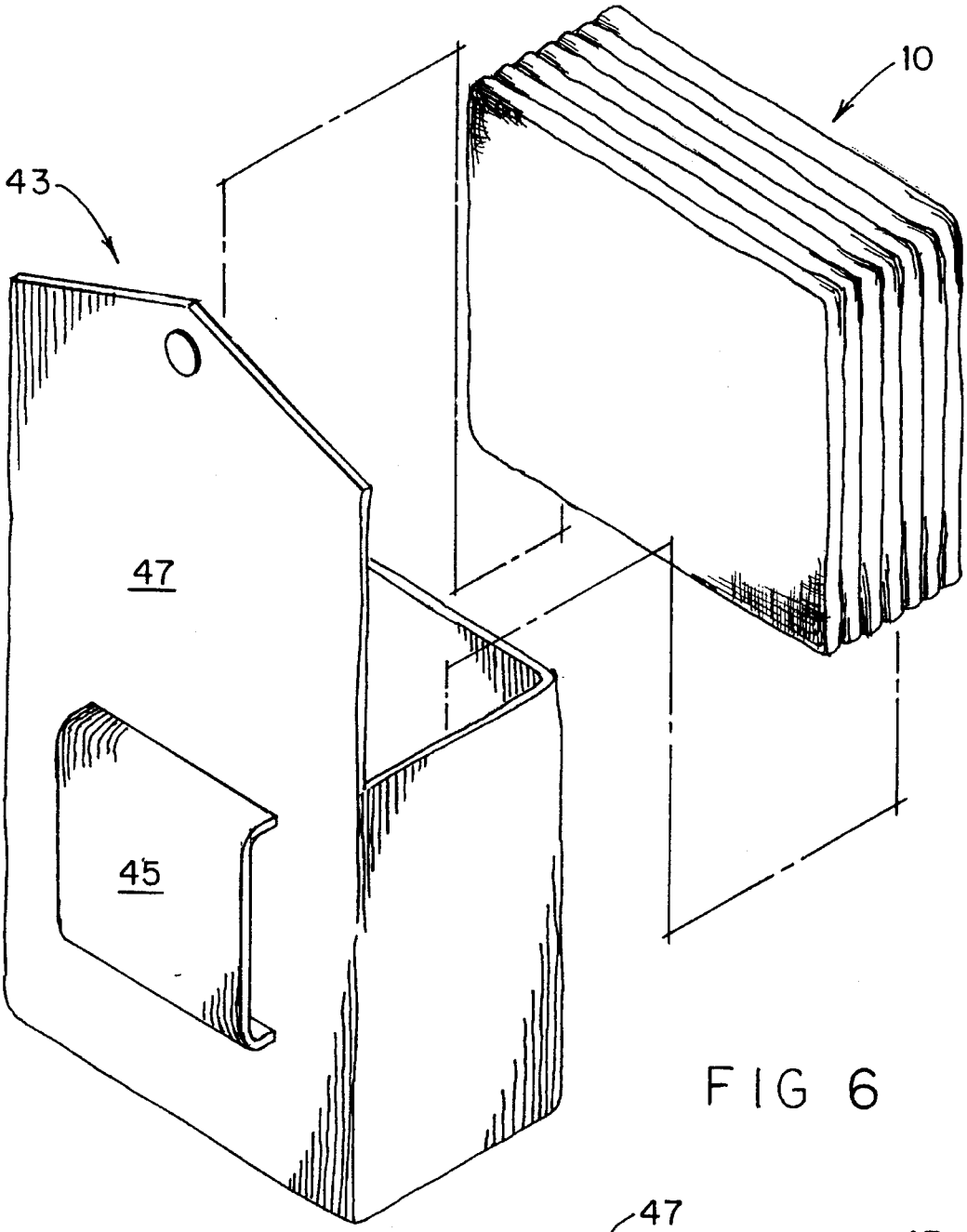
FIG. 6 is a perspective exploded view of the protective mesh garment apparatus of the invention that has been folded up and is about to be placed in a belt-carried carrier.
Figure 7:
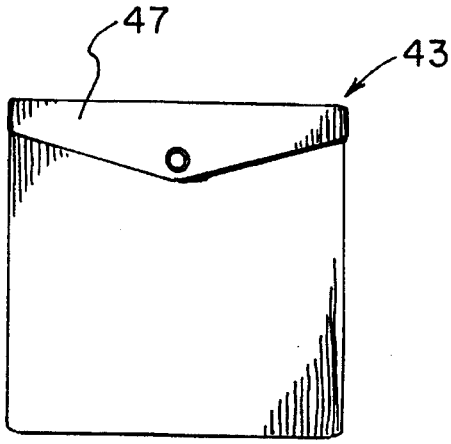
FIG. 7 is a side view of the carrier shown in FIG. 6 with the cover closed.

Turning to FIGS. 6 and 7, a protective mesh garment apparatus of the invention 10 is folded up and is about to be placed in a carrier 43 that has a loop 45 for being carried by a belt. In FIG. 6, the cover 47 of the carrier 43 is open. In FIG. 7, the cover 47 of the carrier 43 is closed.

The protective mesh garment apparatus of the invention is light-weight and folds easily into a small bundle for storage. Preferably, it extends to about midcalf. The central cylindrical portion 17 is roomy enough to allow the wearer to sit or squat and completely cover his legs and feet with the mesh material.

Preferably, the protective mesh garment apparatus is made from commercially available camouflaged mosquito netting such as known as "TreeBark" netting. For an average size man, it takes about five yards of the mesh material to make a protective mesh garment apparatus in accordance with the invention. At current prices, the material costs approximately three dollars per yard.

It is apparent from the above that the present invention accomplishes all of the objects set forth by providing a new and improved protective mesh garment apparatus that is low in cost, relatively simple in design and operation, and which may advantageously be used to protect a wearer against flying insects. More specifically, the protective mesh garment apparatus of the invention serves to protect the wearer's neck, head, and hands from bites from insects; to prevent insects from biting a person without the person wearing chemical repellent agents; to protect a person from bites of flying insects without employing chemicals which may repel wild game; to give hunters adequate protection against flying insects without causing the wearer to experience excessive heat; to avoid risks of tearing and snagging due to shoes or boots; to provide a protective mesh garment that has good camouflage characteristics; and to employ mesh-like fabric in such a way that it has a reduced tendency to cling to one's normal clothes under the protective garment.

Another benefit of the protective mesh garment apparatus of the invention is that success in hunting can be increased by employing the protective mesh garment apparatus. More specifically, the camouflaged mosquito netting is very effective camouflage with respect to deer. Therefore, the deer will get quite close when the hunter wears a camouflaged material of the invention. Moreover, because the protective mesh garment apparatus of the invention is so effective in reducing the hunter's need to swat at flying insects, the hunter can remain very quite and not disturb wildlife. The combined effects of having effective camouflage and being free from swatting insects provide greater potential success in hunting.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A protective mesh garment apparatus for protecting a wearer's head, neck, chest, shoulders, back, abdomen, backside, arms, and a portion of a wearer's legs above a wearer's ankles, said apparatus comprising:

flaccid, cylindrical head covering assembly means, made from mesh material, for completely covering the head and neck of a wearer, and for covering a portion of the chest and shoulders of a wearer, said head covering assembly means having a length and including an open end having a diameter, such that said head covering assembly means are capable of being placed over a wearer's head and are capable of completely covering the head and neck of a wearer and capable of covering a portion of the chest and shoulders of a wearer, flaccid, cylindrical body covering assembly means, made from mesh material, for completely covering the shoulders, chest, back, abdomen, backside, arms, and a portion of a wearer's legs above a wearer's ankles, said body covering assembly means including a central cylindrical portion and two arm portions, wherein said central cylindrical portion has a length and includes a top open end and a bottom open end, wherein said bottom open end has a diameter sufficiently large such that said bottom open end is capable of being lowered over a wearer's head, shoulders, chest, back, abdomen, backside, arms, hands, and a portion of a wearer's legs above a wearer's ankles, said top open end having a diameter sufficiently large such that said top open end is capable of being lowered over a wearer's head but sufficiently small such that said top open end is not capable of being moved past a wearer's shoulders, wherein said arm portions have a length and a diameter sufficient to cover a wearer's arms, said head covering assembly being attached to said body covering assembly by a gathered seam sewn adjacent to said top open end of said body covering assembly means on the side thereof defining the back of said body covering assembly, and further including draping aid assembly means on the inside surface of a portion of said back side of said body covering assembly means proximal to said gathered sewn seam for lifting said body covering assembly means above a wearer's upper back away from a wearer's normal clothing and for aiding draping of said body covering assembly means over a wearer's chest, shoulders and back, wherein said draping aid assembly means include:

at least one pocket defined in said body covering assembly means, said pocket extending transversely across a portion of said back side of said body covering assembly in the region of a wearer's upper back and shoulders, a pocket-insertable member for inserting into said pocket, said pocket-insertable member comprising a rigid pad of styrofoam insertable in said at least one pocket, wherein a portion of said head covering assembly means overlaps a portion of said body covering assembly means when both said head covering assembly means and said body covering assembly means are worn by a wearer, and wherein said diameter of said open end of said head covering assembly means is such that said head covering assembly means are adapted to be placed over a hat worn on a wearer's head, are capable of completely encircling the hat, head, and neck of a wearer, and are capable of covering a portion of the chest, shoulders, and back of a wearer.

2. The garment apparatus of claim 1 wherein said pocket is divided into a plurality of separate compartments by one or more vertical seams sewn in said back side of said body covering assembly means and a said draping aid assembly means comprises a separate styrofoam pad insertable into each of said plurality of pockets, respectively, to form a substantially horizontal row of pocket-insertable pads extending across the upper back and shoulders of a wearer proximal to said gathered seam.

3. The garment apparatus of claim 2 wherein each of said styrofoam pads has a thickness in the range of about 1.5 inches to about 5 inches.

4. The garment apparatus of claim 1 wherein each of said arm portions terminates in an open end and includes a tubular extension for covering a corresponding hand and fingers of a wearer, each said tubular extension extending from said open end, respectively, each of said arm portions further including adjustable strap means proximal to said open end for tightening said open end about the wrist of a wearer.

5. The garment apparatus of claim 4 wherein said adjustable strap means comprises a pair of straps, each of said straps having one end attached to said arm portion and a freely extending opposite end, the freely extending opposite end of each said strap having hook or loop fastening material thereon.

* * * * *